US009808808B2

(12) United States Patent
Wen et al.

(10) Patent No.: US 9,808,808 B2
(45) Date of Patent: Nov. 7, 2017

(54) ELECTROSTATIC PRECIPITATOR

(71) Applicant: University of Washington, Seattle, WA (US)

(72) Inventors: Tsrong-Yi Wen, Seattle, WA (US); Alexander V. Mamishev, Seattle, WA (US)

(73) Assignee: University of Washington, Seattle, WA (US)

( * ) Notice: Subject to any disclaimer, the term of this patent is extended or adjusted under 35 U.S.C. 154(b) by 97 days.

(21) Appl. No.: 14/851,525

(22) Filed: Sep. 11, 2015

(65) Prior Publication Data

US 2016/0074878 A1 Mar. 17, 2016

Related U.S. Application Data

(60) Provisional application No. 62/049,519, filed on Sep. 12, 2014.

(51) Int. Cl.

| | |
|---|---|
| ***B03C 3/45*** | (2006.01) |
| ***B03C 3/08*** | (2006.01) |
| ***B03C 3/12*** | (2006.01) |
| ***B03C 3/41*** | (2006.01) |
| ***B03C 3/47*** | (2006.01) |
| ***B03C 3/60*** | (2006.01) |
| ***B03C 3/70*** | (2006.01) |

(52) U.S. Cl.

CPC ..... *B03C 3/08* (2013.01); *B03C 3/12* (2013.01); *B03C 3/41* (2013.01); *B03C 3/47* (2013.01); *B03C 3/60* (2013.01); *B03C 3/70* (2013.01)

(58) Field of Classification Search

CPC combination set(s) only.
See application file for complete search history.

(56) References Cited

U.S. PATENT DOCUMENTS 1,992,974 A * 3/1935 Thompson ..... B03C 3/155 209/127.1
4,166,729 A * 9/1979 Thompson ..... B03C 3/60 96/79
4,233,037 A * 11/1980 Pontius ..... B03C 3/41 95/79
5,421,863 A * 6/1995 Rector ..... B03C 3/70 95/78

(Continued)

FOREIGN PATENT DOCUMENTS

DE 2854742 A1 * 7/1980 ..... B03C 3/12

OTHER PUBLICATIONS

Alonso et al., "The measurement of charging efficiencies and losses of aerosol nanoparticles in a corona charger," Journal of Electrostatics 64, 2006, 203-214.

(Continued)

*Primary Examiner* — Duane Smith
*Assistant Examiner* — Sonji Turner
(74) *Attorney, Agent, or Firm* — McDonnell Boehnen Hulbert & Berghoff LLP

(57) ABSTRACT

An electrostatic precipitator is constructed with collecting and repelling electrodes. The collecting electrode is partially shielded from gas shear forces by a shielding structure. The shielding structure is mounted to reduce gas flow along a surface of the collector and includes passages for charged particles to travel to be captured by the collector.

9 Claims, 2 Drawing Sheets

(56) References Cited

U.S. PATENT DOCUMENTS

| | | | | |
|---|---|---|---|---|
| 5,766,318 | A * | 6/1998 | Loreth | B03C 3/60 96/69 |
| 5,993,521 | A * | 11/1999 | Loreth | B03C 3/12 96/69 |
| 6,773,488 | B2 * | 8/2004 | Potter | B03C 3/60 55/DIG. 39 |
| 8,470,084 | B2 * | 6/2013 | Ji | B03C 3/08 313/355 |
| 8,574,353 | B2 * | 11/2013 | Nazuka | B03C 3/09 96/62 |
| 2014/0053727 | A1 * | 2/2014 | Miller | B03C 3/361 95/78 |

OTHER PUBLICATIONS

Brook et al., "Particulate Matter Air Pollution and Cardiovascular Disease," Circulation, 2010, 2331-2378.
Edelman, "Air filtration: Air filter media—an industry evolves," Filtration+ Separation, 2008, 24-26.
Ferge et al., "Particle Collection Efficiency and Particle Re-entrainment of an Electrostatic Precipitator in a Sewage Sludge Incineration Plant," Environ. Sci. Technol., 2004, 38, 1545-1553.
Fisk et al., "Performance and costs of particle air filtration technologies," Indoor Air, 2002; 12; 233-234.
Jiang et al., "Model for nanoparticle charging by diffusion, direct photoionization, and thermionization mechanisms," Journal of Electrostatics 65, 2007, 209-220.
Krichtafovitch et al., "Design of an electronic air cleaner with porous collecting electrodes," Proc. ESA Annual Meeting on Electrostatics, 2013, 1-8.
Marquard et al., "Nanoparticle charging efficiencies and related charging conditions in a wire-tube ESP at DC energization," Journal of Electrostatics 63, 2005, 693-698.
Mizuno, "Electrostatic Precipitation," IEEE Transactions on Dielectrics and Electrical Insulation, 2000, vol. 7 No. 5, 615-624.
Railio et al., "Specific Fan Power—a tool for better performance of air handling systems," Proceedings of Clima 2007 WellBeing Indoors, 1-6.
Tsai et al., "A model of particle re-entrainment in electrostatic precipitators," J. Aerosol Sci. 1995, vol. 26, No. 2, 227-239.
Wellenius et al., "Ambient air pollution and the risk of acute ischemic stroke," Arch Intern Med, 2012, vol. 172 (No. 3), 229-234.
Wen et al., "Novel electrodes of an electrostatic precipitator for air filtration," Journal of Electrostatics 73, 2015, 117-124.
Wen et al., "Reduction of aerosol particulates through the use of an electrostatic precipitator with guidance-plate-covered collecting electrodes," Journal of Aerosol Science 79, 2015, 40-47.
Xu et al., "Performance of large fan-filter units for cleanroom applications," Building and Environment 42, 2007, 2299-2304.
Zhuang et al., "Experimental and theoretical studies of ultra-fine particle behavior in electrostatic precipitators," Journal of Electrostatics 48, 2000, 245-260.
Zukeran et al., "Two-Stage-Type Electrostatic Precipitator Re-Entrainment Phenomena Under Diesel Flue Gasses," IEEE Transactions on Industry Applications, 1999, vol. 35 No. 2, 346-351.

* cited by examiner

ELECTROSTATIC PRECIPITATOR

CROSS-REFERENCE TO RELATED APPLICATIONS

This application claims the benefit of U.S. Provisional Application No. 62/049,519 filed Sep. 12, 2014 entitled Novel Electrostatic Precipitator with Guidance-Plate-Covered Electrodes, the disclosure of which is hereby expressly incorporated herein by reference in its entirety.

BACKGROUND OF THE INVENTION

1. Field of the Invention

The present technology relates generally to cleaning gas flows using an electrostatic precipitator and particularly to collector assemblies with open-cell structures.

2. Description of the Related Technology

The most common types of residential or commercial HVAC filters employ a fibrous filter media (made from polyester fibers, glass fibers or microfibers, etc.) placed substantially perpendicular to the airflow through which air may pass (e.g., an air conditioner filter, a HEPA filter, etc.) such that particles are removed from the air mechanically (coming into contact with one or more fibers and either adhering to or being blocked by the fibers); some of these filters are also electrostatically charged (either passively during use, or actively during manufacture) to increase the chances of particles coming into contact and staying adhered to the fibers.

Fibrous media filters typically have to be cleaned and/or replaced regularly due to an accumulation of particles. Furthermore, fibrous media filters are placed substantially perpendicular to the airflow, increasing airflow resistance and causing a significant static pressure differential across the filter, which increases as more particles accumulate or collect in the filter. Pressure drop across various components of an HVAC system is a constant concern for designers and operators of mechanical air systems, since it either slows the airflow or increases the amount of energy required to move the air through the system. Accordingly, there exists a need for an air filter capable of relatively long intervals between cleaning and/or replacement and a relatively low pressure drop across the filter after installation in an HVAC system.

Another form of air filter is known as an electrostatic precipitator. A conventional electrostatic precipitator includes one or more corona electrodes and one or more smooth metal electrode plates that are substantially parallel to the airflow. The corona electrodes produce a corona discharge that ionizes air molecules in an airflow received into the filter. The ionized air molecules impart a net charge to nearby particles (e.g., dust, dirt, contaminants etc.) in the airflow. The charged particles are subsequently electrostatically attracted to one of the electrode plates and thereby removed from the airflow as the air moves past the electrode plates. After a sufficient amount of air passes through the filter, the electrodes can accumulate a layer of particles and dust and eventually need to be cleaned. Cleaning intervals may vary from, for example, thirty minutes to several days to several months. Further, since the particles are on an outer surface of the electrodes, they may become re-entrained in the airflow since a force of the airflow may exceed the electric force attracting the charged particles to the electrodes, especially if many particles agglomerate through attraction to each other, thereby reducing the net attraction to the collector plate. There are other sources that may cause particle re-entrainment as well, such as strong airflow, vibrations, and spark discharging. Such agglomeration and re-entrainment may require use of a media filter that is placed substantially perpendicular to the airflow, thereby increasing airflow resistance.

U.S. patent application Ser. No. 14/401,082 filed on 15 May 2013 and published 21 Nov. 2013, the disclosure of which is expressly incorporated by reference herein shows an electrostatic precipitator with improved performance. An article by Wen, T.; Wang, H.; Krichtafovitch, I.; and Mamishev, A. entitled *Novel Electrodes of an Electrostatic Precipitator for Air Filtration*, submitted to the Journal of Electrostatics, Nov. 12, 2014, the disclosure of which is expressly incorporated herein by reference, presents working principles of electrostatic precipitators and provides a discussion on the design concepts and schematics of a foam-covered ESP. The collector electrodes in the electrostatic precipitator described therein may be covered with porous foam. Electrostatic precipitators with foam-covered electrodes have improved capacity for particle collection, due in part, to the increased surface area of foam over metal collector plates and improved filtration efficiency because the effect of particle reentrainment is reduced. Nevertheless, foam-covered electrostatic precipitators described in U.S. application Ser. No. 14/401,082 would have even better performance in some environments, particularly very dusty areas, if the collection capacity were increased thereby reducing the frequency of foam collector cleaning or replacement.

SUMMARY OF THE INVENTION

It is an object of the invention to improve particle capture and retention.

It is an object of the invention to enhance performance of electrostatic precipitator collectors, and particularly while filtering wide range of the particles: from micron size to sub-micron and ultra-fine (e.g.) nano-meter size particles.

An electrostatic precipitator according to the invention may have a housing with a housing cavity. One or more corona electrodes may be mounted in an air flow path in the housing. A plurality of first electrodes and a plurality of second electrodes may be mounted in the housing cavity where the first electrodes may be collector electrodes positioned generally parallel to an airflow path through said housing cavity. At least one perforated plate may be located parallel to one of the collector plates. Perforated plates may be mounted on both sides of the collector plate. The electrostatic precipitator collector electrode may have a conductive core and open-cell collector structures mounted on the conductive core. The perforated plate may be electrically isolated from the collector electrode. The perforated plate may be non-conductive. The perforated plate may be attached to one of the collector electrodes by a one or more spacers that at least partially blocks air flow between the leading end portion of the collector electrode and a leading end portion of the perforated plate. In addition, the perforated plate may have flow passages of increased size in a downwind portion of the perforated plate.

Various objects, features, aspects, and advantages of the present invention will become more apparent from the following detailed description of preferred embodiments of the invention, along with the accompanying drawings in which like numerals represent like components.

Moreover, the above objects and advantages of the invention are illustrative, and not exhaustive, of those that can be achieved by the invention. Thus, these and other objects and advantages of the invention will be apparent from the description herein, both as embodied herein and as modified in view of any variations which will be apparent to those skilled in the art.

DETAILED DESCRIPTION OF A PREFERRED EMBODIMENT

Figure 1:
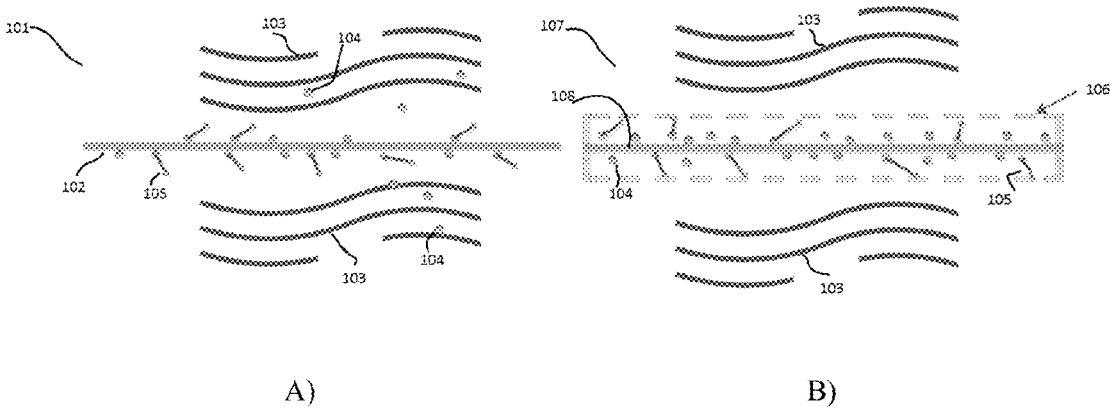
FIG. 1A) illustrates a schematic view of an electrostatic precipitator with bare electrodes. B) illustrates a schematic view of the electrostatic precipitator with guidance-plate-covered electrode.

Before the present invention is described in further detail, it is to be understood that the invention is not limited to the particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It must be noted that as used herein and in the appended claims, the singular forms "a", "an", and "the" include plural referents unless the context clearly dictates otherwise.

All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates, which may need to be independently confirmed.

The present technology relates generally to cleaning gas flows using electrostatic precipitators and associated systems and methods. In one aspect of the present technology, an electrostatic precipitator may include a housing having an inlet, an outlet, and a cavity there between. An electrode assembly positioned in the air filter between the inlet and the outlet can include a plurality of first electrodes (e.g., electrodes) and a plurality of second electrodes (e.g., repelling electrodes), both configured substantially parallel to the airflow.

In another aspect of the present technology, a method of filtering air may include creating an electric field using a plurality of corona electrodes arranged in an airflow path, such that the corona electrodes are positioned to ionize a portion of air molecules from the airflow. The method may also include applying a first electric potential at a plurality of first electrodes spaced apart from the corona electrodes, and receiving, at the first collection portion, particulate matter electrically coupled to the ionized air molecules.

Prior electrostatic precipitator collectors 101, illustrated schematically in FIG. 1A include a conventional first electrode 102 as a flat plate. Air flow 103 is schematically shown directed from the left to the right. Particles 104 are in the air flow path. Particles 105 collected on the surface of the first electrode are subject to reentrainment back to the air under the influence of aerodynamic forces shown symbolically as arrows. Particles 105 are attracted to the surface of first electrodes 102 by electrostatic forces between the first electrode 102 and the second electrode (shown as 205 in the FIG. 2). When electrostatic forces are weak or absent (power outage, for example) the attraction force between the particles and collector may pore easily separate from the surface of the collector and may escape (reentry) back to the air.

FIG. 1B shows a schematic of a novel collector assembly 107. A collecting electrode (first electrode) may include a flat plate 108 which is electrically conductive. The plate 108 may be covered by perforated plate 106. Perforated plate 106 may advantageously be non-conductive. Charged particles 104 and 105 may penetrate to the area between the plate 106 and flat plate 108 and are trapped there. Some particles 104 may enter the quite zone where air flow is minimal. Some particles like 105 settled downstream of the plate 108 where air flow is of some appreciated value. The plate 106 may prevent the particles 104 from escaping even if power and electrostatic force do not exist.

Figure 2:
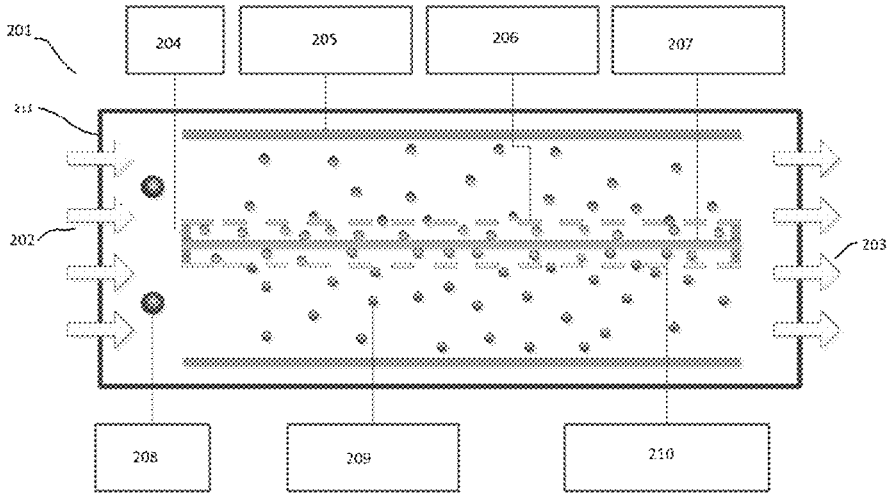
FIG. 2 illustrates a more detailed view of an electrostatic precipitator with guidance-plate-covered electrode.

FIG. 2 shows an electrostatic precipitator 201 that includes a housing 211 with an air inlet 202 and air outlet 203. It also may include corona electrodes 208 which are in this example thin electrically conductive wires connected to a power source (not shown). The first electrode may have an electrically conductive plate 207, perforated plates 206, and spacers 204. The second electrodes 205 may be plate-like electrically conductive members connected to a power source, not shown here. When sufficient voltage (several kilovolts) is applied to the corona electrodes 208 they may emit ions that are blown from the left to the right as shown by arrows. These ions may attach to the particles in the air 209. When voltage is also applied to the second electrodes 205 an electric field is created between the first electrode plate 207 and the second electrode 205. Under the influence of this electric field, charged particles 209 may be pushed toward the plate 207. These particles may penetrate though the perforations of the plate 206 and settle on or near the plate 207. The spacers 204 block the air from flowing in between the leading end of the plate 207 and the leading end of the perforated plate 206. Thus the collected particles 210 are located in a quiet zone and have little chance of escaping back to the air.

Figure 3:
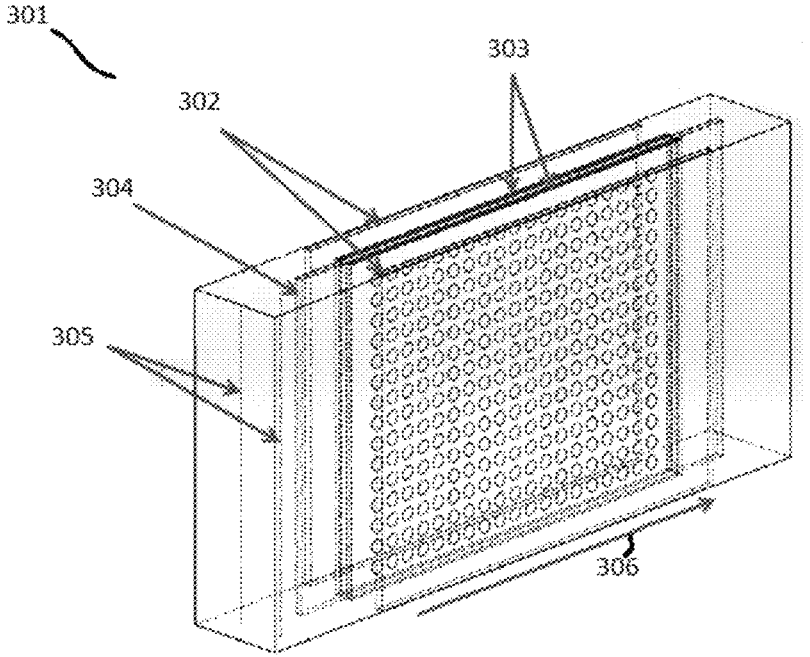
FIG. 3 shows an isometric view of an electrostatic precipitator with guidance-plate-covered electrode.

FIG. 3 shows an isometric view of an electrode stage 301 of an electrostatic precipitator. Second electrodes 302 alternate with conductive electrode 304. A perforated plate 303 may be positioned on each side of the conductive electrode 304. The perforated plates 303 shield the collector, conductive plate 304, from the primary air flow passages thus reducing the shear forces of the airflow on the collector. The corona electrodes are shown as 305 and 306 in the direction of the air flow.

The collector electrode may be a conductive plate or a collector made of open-cell foam with a conductive core. The perforated plate is not limited by the manner of fabrication or shape of the passages. A perforated plate for the purpose of this invention may be any structure that reduces the air flow incident on a collector but still allows passage of particles for collection.

The invention is described in detail with respect to preferred embodiments, and it will now be apparent from the foregoing to those skilled in the art that changes and modifications may be made without departing from the invention in its broader aspects, and the invention, therefore, as defined in the claims, is intended to cover all such changes and modifications that fall within the true spirit of the invention.

Thus, specific apparatus for and methods of electrostatic precipitation and particle collection have been disclosed. It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

We claim:

1. An electrostatic precipitator comprising:

a housing with a housing cavity;

one or more corona electrodes mounted in an air flow path in said housing;

a plurality of first electrodes and a plurality of second electrodes mounted in said housing cavity, wherein said first electrodes are collector electrodes positioned generally parallel to an airflow path through said housing cavity;

at least one perforated plate located parallel to one of said collector electrodes, wherein said perforated plate is spaced apart from said collector electrodes defining a gap between said perforated plate and said collector electrodes.

2. The electrostatic precipitator according to claim 1, wherein said collector electrodes comprise a conductive core and open-cell collector structures mounted on said conductive core.

3. The electrostatic precipitator according to claim 1, wherein said perforated plate is electrically isolated from said collector electrodes.

4. The electrostatic precipitator according to claim wherein said perforated plate is non-conductive.

5. The electrostatic precipitator according to claim 1, wherein said perforated plate is attached to one of said collector electrodes by one or more spacers that at least partially blocks air flow between a leading end portion of said collector electrode and a leading end portion of said perforated plate.

6. The electrostatic precipitator according to claim 1, wherein said perforated plate has air flow passages of increased size in a downwind portion of said perforated plate and has air flow passages of a decreased size in an upwind portion of said perforated plate.

7. An electrostatic collector assembly comprising:

a conductive core;

one or more perforated plates positioned adjacent to and spaced from said conductive core; and an airflow barrier between said conductive core and said one or more perforated plates arranged to block at least a portion of the airflow along a surface of said conductive core.

8. The electrostatic collector assembly according to claim 7, wherein said one or more perforated plates are positioned in parallel to one or more collector electrodes.

9. The electrostatic precipitator according to claim 5, wherein said perforated plate has air flow passages of increased size in a downwind portion of said perforated plate and has air flow passages of a decreased size in an upwind portion of said perforated plate.

* * * * *